US008684513B2

(12) United States Patent
Tsunoya

(10) Patent No.: US 8,684,513 B2
(45) Date of Patent: Apr. 1, 2014

(54) RECORDING METHOD

(75) Inventor: Akihiko Tsunoya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 80 days.

(21) Appl. No.: 13/362,168

(22) Filed: Jan. 31, 2012

(65) Prior Publication Data

US 2012/0200652 A1 Aug. 9, 2012

(30) Foreign Application Priority Data

Feb. 3, 2011 (JP) ..... 2011-021457

(51) Int. Cl.
*B41J 2/01* (2006.01)

(52) U.S. Cl.
USPC ..... 347/102

(58) Field of Classification Search
USPC ..... 347/102, 104
See application file for complete search history.

(56) References Cited

U.S. PATENT DOCUMENTS

| | | | |
|---|---|---|---|
| 6,027,197 A | 2/2000 | Kaburagi et al. | |
| 6,467,866 B1 | 10/2002 | Nagoshi et al. | |
| 6,652,066 B2 | 11/2003 | Teshigawara et al. | |
| 6,729,710 B2 | 5/2004 | Chikuma et al. | |
| 7,301,668 B2 | 11/2007 | Kawanabe et al. | |
| 7,794,076 B2 | 9/2010 | Nakano et al. | |
| 2009/0322820 A1* | 12/2009 | Usuda et al. | 347/16 |
| 2010/0118318 A1 | 5/2010 | Fuse et al. | |
| 2010/0225940 A1* | 9/2010 | Gargir et al. | 358/1.9 |

FOREIGN PATENT DOCUMENTS

| | | |
|---|---|---|
| JP | 06-270472 A | 9/1994 |
| JP | 10-329343 A | 12/1998 |
| JP | 2002-103575 A | 4/2002 |
| JP | 2002-200745 A | 7/2002 |
| JP | 2002-361853 A | 12/2002 |
| JP | 2008-188984 A | 8/2008 |
| JP | 2009-119806 A | 6/2009 |
| JP | 2010-137553 A | 6/2010 |

* cited by examiner

*Primary Examiner* — Julian Huffman
*Assistant Examiner* — Sharon A Polk
(74) *Attorney, Agent, or Firm* — Global IP Counselors, LLP

(57) ABSTRACT

A recording method is for recording on a recording medium with a photocuring liquid substance by discharging droplets from a discharge head onto the recording medium while displacing the discharge head and the recording medium relative to each other. While the discharge head and the recording medium are displaced relative to each other, a droplet discharge step of discharging the droplets from the discharge head toward a predetermined section of the recording medium, and a radiation step of radiating the light toward the droplets discharged on the recording medium, are performed n (n being an integer of 2 or greater) times on the predetermined section to complete recording on the predetermined section, and the recording rate in the nth discharge step is lowered below 100%/n.

5 Claims, 6 Drawing Sheets

RECORDING METHOD

CROSS-REFERENCE TO RELATED APPLICATIONS

This application claims priority to Japanese Patent Application No. 2011-021457 filed on Feb. 3, 2011. The entire disclosure of Japanese Patent Application No. 2011-021457 is hereby incorporated herein by reference.

BACKGROUND

1. Technical Field

The present invention relates to recording method or the like.

2. Related Art

An inkjet device is one known example of a liquid discharge device that can discharge a liquid substance as droplets. An inkjet device can form dots on a recording medium by discharging ink or another liquid substance as droplets from a discharge head. Various images can be recorded by using such an inkjet device.

In the field of recording using an inkjet device, a method for recording with ink that hardens from exposure to ultraviolet light (hereinbelow referred to as UV ink) has been known in the past (see Japanese Laid-Open Patent Publication No. 2008-188984, for example).

SUMMARY

In the field of recording using UV ink, the dots formed on the recording medium sometimes solidify in a state of protruding from the surface of the recording medium. Furthermore, in cases in which tone or color is expressed, a plurality of dots will sometimes become superimposed. As a result of these things, bumps sometimes form in the image. The bumps forming in the image are sometimes visible as an unintended striped pattern. Therefore, bumps forming in the image readily lower the quality of the image.

Thus, a problem with conventional recording methods is that it is difficult to improve the image quality.

The present invention was devised in order to resolve at least some of the problems described above, and the present invention can be implemented as the following embodiments or applied examples.

A recording method according to a first aspect of the present invention is a method for recording a liquid substance on a recording medium by discharging droplets from a discharge head onto the recording medium while displacing the discharge head and the recording medium relative to each other, the discharge head discharging the liquid substance as the droplets, the liquid substance having a photocuring property that is hardened by exposure to light radiation. The recording method includes a droplet discharge step of discharging the droplets from the discharge head toward a predetermined section of the recording medium, and a radiation step of radiating the light toward the droplets discharged on the recording medium. The droplet discharge step and the radiation step are performed n times, with n being an integer of 2 or greater, on the predetermined section to complete recording on the predetermined section while the discharge head and the recording medium are displaced relative to each other. A recording rate in the nth discharge step is lowered below 100%/n.

The recording method of this applied example is a recording method for recording with a liquid substance on a recording medium by discharging droplets from a discharge head onto the recording medium while displacing the discharge head and the recording medium relative to each other, the discharge head discharging a photocuring liquid substance as droplets. Photocuring is the property of being hardened by exposure to light radiation.

In this recording method, a crossing step and a radiation step are performed n times on the same section of the recording medium, whereby recording is completed on the same section. The same section is a section of the recording medium and is within a range that overlaps the discharge head.

In the crossing step, the discharge head is made to cross the same section while droplets are discharged from the discharge head onto the same section of the recording medium.

In the radiation step following the crossing step, light is radiated onto the same section. Hardening of the liquid substance in the same section is thereby facilitated.

In this recording method, the crossing step and the radiation step are performed n times on the same section of the recording medium, whereby recording on the same section is completed. At this time, the recording rate in the $n^{th}$ crossing step is lowered below 100%/n. Thereby, it becomes easy to reduce the occurrence of striped patterns in the image.

The term "recording rate" refers to the percentage of dots formed during recording when the number of dots that represent one completed image is 100.

In the recording method described above preferably, in the n droplet discharge steps, with a recording rate of a first droplet discharge step being denoted by a %, the recording rate of a final droplet discharge step being denoted by b %, and a recording rate of one of the n droplet discharge steps other than the first or final droplet discharge step being denoted by c %: $a \geq c \geq b$ (and $a > b$).

Thereby, it becomes easy to reduce the occurrence of striped patterns in the image.

In the recording method described above, in all of the n droplet discharge steps, an amount of droplets discharged per dot is preferably equal for the same recording data.

Thereby, it becomes easy to reduce the occurrence of striped patterns in the image.

In the recording method described above, an amount of light radiated is preferably equal in all the n radiation steps.

Thereby, it becomes easy to reduce the occurrence of striped patterns in the image.

In the recording method described above, the light is preferably ultraviolet light.

In this applied example, recording can be performed on a recording medium with a liquid substance that is hardened by being exposed to radiation of ultraviolet light.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
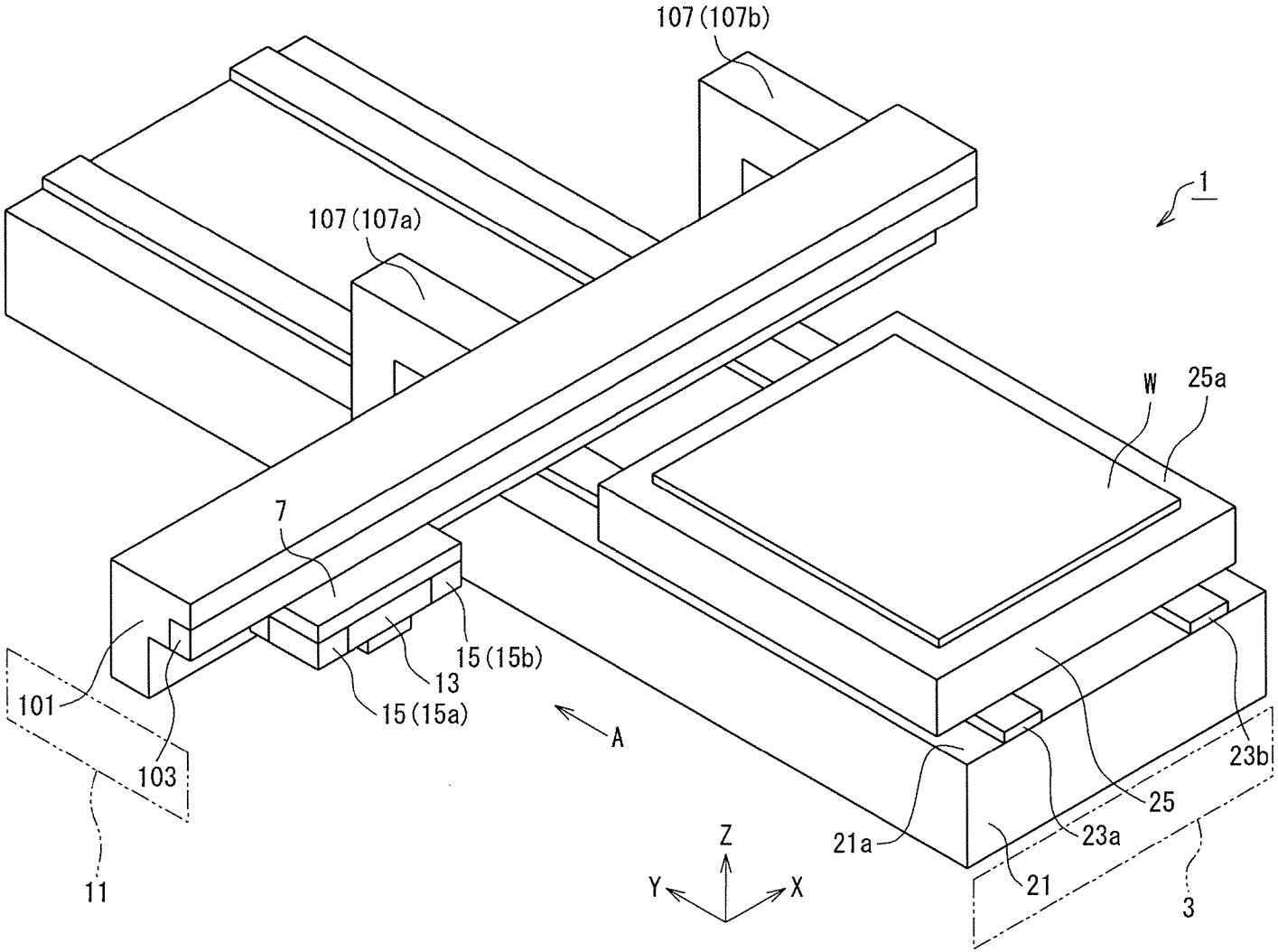
FIG. 1 is a perspective view showing the schematic configuration of a liquid discharge device in the present embodiment.

With reference to the drawings, a liquid discharge device is used as an example of a recording device to describe the embodiment. The configurations and members are sometimes scaled differently in the drawings in order to present the configurations in recognizable sizes.

A liquid discharge device 1 in the present embodiment has a workpiece conveying device 3, a carriage 7, and a carriage conveying device 11, as shown in FIG. 1 which is a perspective view showing the schematic configuration.

The carriage 7 is provided with a head unit 13 and two radiation devices 15.

With the liquid discharge device 1, a desired pattern can be drawn (recorded) on a substrate or other workpiece W with a liquid substance by discharging the liquid substance as droplets from the head unit 13 while varying the relative positions of the head unit 13 and the workpiece W in a plan view. The Y direction in the drawing shows the movement direction of the workpiece W, and the X direction shows a direction orthogonal to the Y direction in a plan view. The direction orthogonal to the XY plane is defined by the X direction and the Y direction is defined as the Z direction.

Such a liquid discharge device 1 is applicable to drawing (recording) on a workpiece W not readily permeable by the liquid substance, such as a resin film or the like, for example.

The liquid discharge device 1 is also applicable to, e.g., the manufacture of color filters used in liquid crystal display panels and the like, the manufacture of organic EL devices, and other applications.

In the case of a color filter having the three filter elements red, green, and blue, the liquid discharge device 1 can be suitably used in the process of forming colored layers of red, green, and blue on a substrate, for example. In this case, liquids corresponding to the colored layers are discharged as droplets from the head unit 13 onto the workpiece W, whereby a pattern of the filter elements red, green, and blue is drawn on the workpiece W.

In the manufacture of organic EL devices, the liquid discharge device 1 can also be suitably used in the process of forming functional layers (organic layers) corresponding to the colors for each red, green, and blue pixel, for example. In this case, liquid substances corresponding to functional layers of the colors are discharged as droplets from the head unit 13 onto the workpiece W, whereby a pattern of the functional layers of red, green, and blue is drawn on the workpiece W.

The configurations of the liquid discharge device 1 are described herein in detail.

The workpiece conveying device 3 has a press platen 21, a guide rail 23*a*, a guide rail 23*b*, and a workpiece table 25, as shown in FIG. 1.

The press platen 21 is made of stone, for example, or another material having a low thermal expansion coefficient, and is set up so as to extend along the Y direction. The guide rail 23*a* and the guide rail 23*b* are placed on a top surface 21*a* of the press platen 21. The guide rail 23*a* and the guide rail 23*b* both extend along the Y direction. The guide rail 23*a* and the guide rail 23*b* are aligned separated from each other by a space in the X direction.

The workpiece table 25 is provided in a state of facing the top surface 21*a* of the press platen 21 with the guide rail 23*a* and the guide rail 23*b* in between. The workpiece table 25 is placed on the guide rail 23*a* and the guide rail 23*b* in a state of being raised above the press platen 21. The workpiece table 25 has a placement surface 25*a* which is a surface on which the workpiece W is placed. The placement surface 25*a* is made to face in the direction (upward) opposite the press platen 21. The workpiece table 25 is guided along the Y direction by the guide rail 23*a* and the guide rail 23*b*, and is capable of reciprocating along the Y direction over the press platen 21.

The workpiece table 25 can be reciprocated in the Y direction by a movement mechanism and a motive power source (neither shown). The movement mechanism can be a mechanism that combines a ball screw and a ball nut, a linear guide mechanism, or the like, for example. In the present embodiment, a workpiece conveying motor (described hereinafter) is used as a motive power source for moving the workpiece table 25 along the Y direction. Various motors can be used as the workpiece conveying motor, including a stepping motor, a servo motor, a linear motor, and the like.

The motive power from the workpiece conveying motor is transmitted through the movement mechanism to the workpiece table 25. The workpiece table 25 can thereby reciprocate along the guide rail 23*a* and the guide rail 23*b*, i.e., along the Y direction. In other words, the workpiece conveying device 3 can cause the workpiece W placed on the placement surface 25*a* of the workpiece table 25 to reciprocate along the Y direction.

Figure 2:
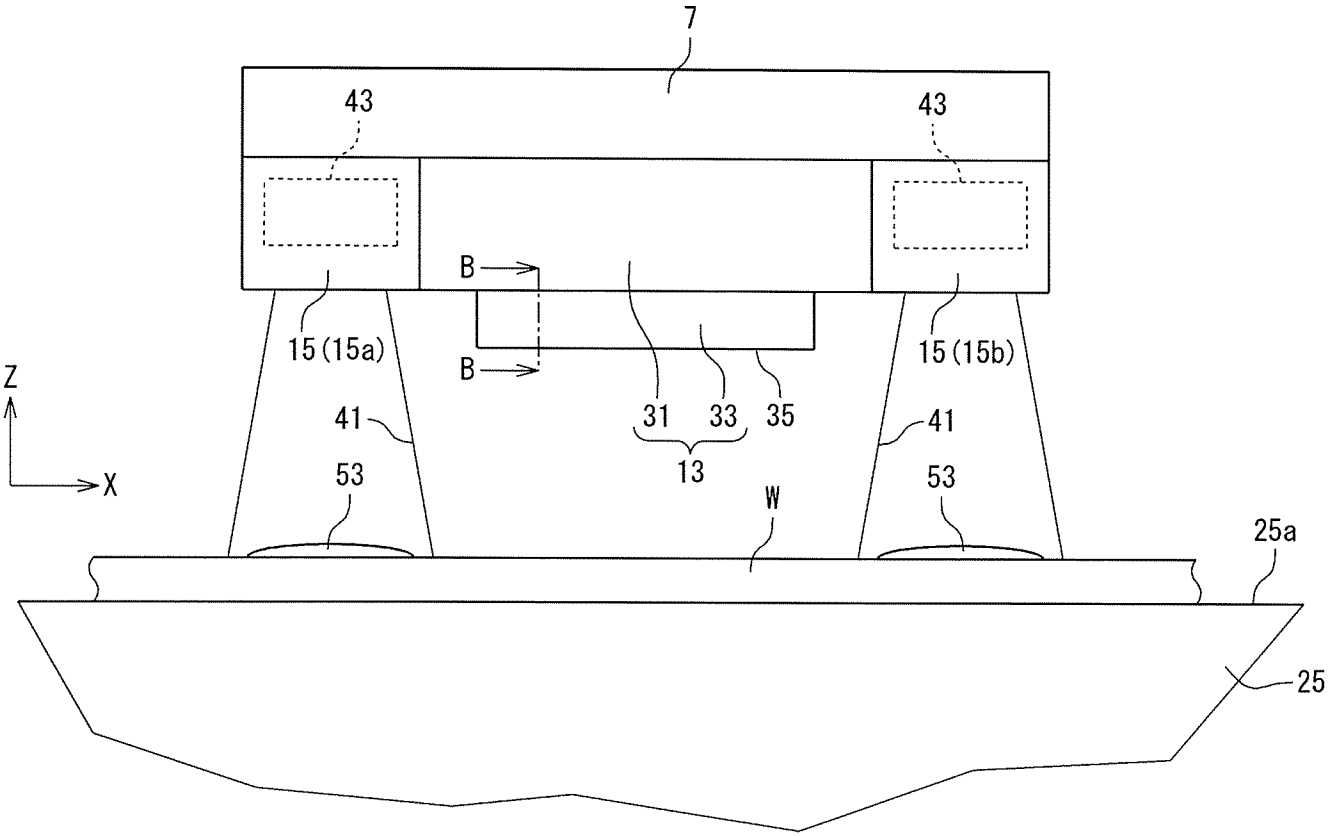
FIG. 2 is a front view of the carriage in the present embodiment as seen from the direction A in FIG. 1.

The head unit 13 has a head plate 31 and a discharge head 33 as shown in FIG. 2, which is a front view of the carriage 7 as seen from the direction A in FIG. 1.

Figure 3:
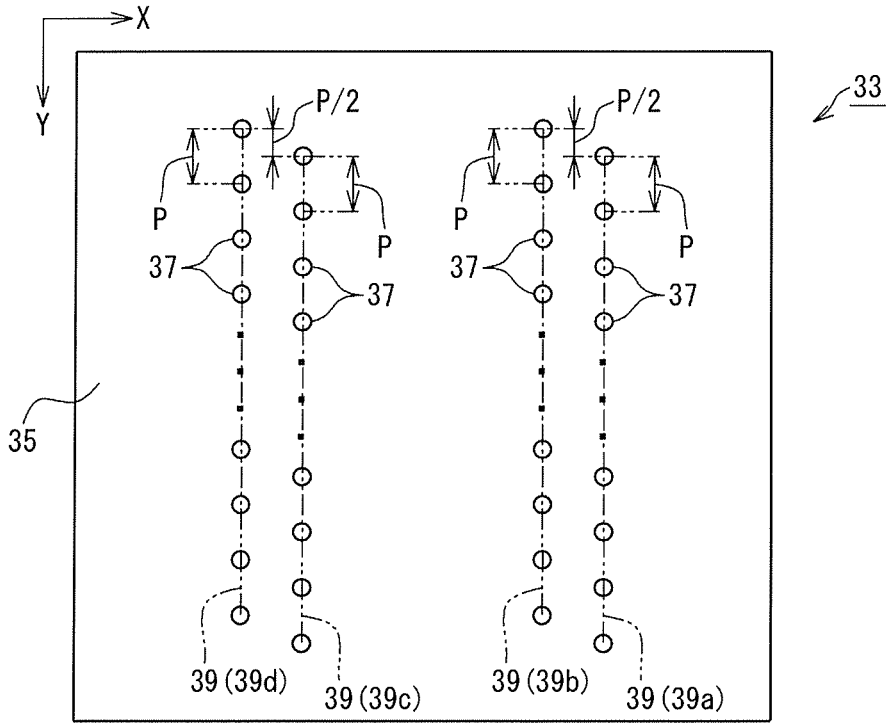
FIG. 3 is a bottom view of the discharge head in the present embodiment.

The discharge head 33 has a nozzle surface 35 as shown in FIG. 3, which is a bottom view. The nozzle surface 35 has a plurality of nozzles 37 formed therein. In FIG. 3, the nozzles 37 are exaggerated and the number of nozzles 37 is reduced in order to make the nozzles 37 easier to understand.

In the discharge head 33, the nozzles 37 constitute four nozzle rows 39 aligned along the Y direction. The four nozzle rows 39 are aligned separated from each other by spaces in the X direction. In the nozzle rows 39, the nozzles 37 are formed at a predetermined nozzle pitch P along the Y direction.

Hereinbelow, the terms nozzle row 39*a*, nozzle row 39*b*, nozzle row 39*c*, and nozzle row 39*d* are used when distinguishing the four nozzle rows 39.

In the discharge head 33, the nozzle row 39*a* and the nozzle row 39*b* are misaligned from each other in the Y direction by a distance P/2. The nozzle row 39*c* and the nozzle row 39*d* are also misaligned from each other in the Y direction by a distance P/2.

The two radiation devices 15 are provided at positions facing each other with the head unit 13 in between in the X direction, as shown in FIG. 2. Hereinbelow, the terms radiation device 15*a* and radiation device 15*b* are used when distinguishing between the two radiation devices 15.

The radiation device 15*a* and radiation device 15*b* each have a light source 43 for emitting ultraviolet light 41. The ultraviolet light 41 from the light sources 43 promote hardening of the functional liquid 53 (liquid substance) discharged from the discharge head 33. The functional liquid 53 begins to harden upon being irradiated by the ultraviolet light 41.

Various light sources 43 can be used as the light sources 43, such as LEDs, LDs, mercury lamps, metal halide lamps, xenon lamps, excimer lamps, and the like, for example.

In the present embodiment, the lengths of the radiation devices 15 in the Y direction are set to the length that encompasses the nozzle rows 39 of the discharge head 33.

The light source 43 of the radiation device 15*a* and the light source 43 of the radiation device 15*b* overlap in a plan view in the movement path of the nozzle surface 35 of the discharge head 33 along the X direction.

Figure 4:
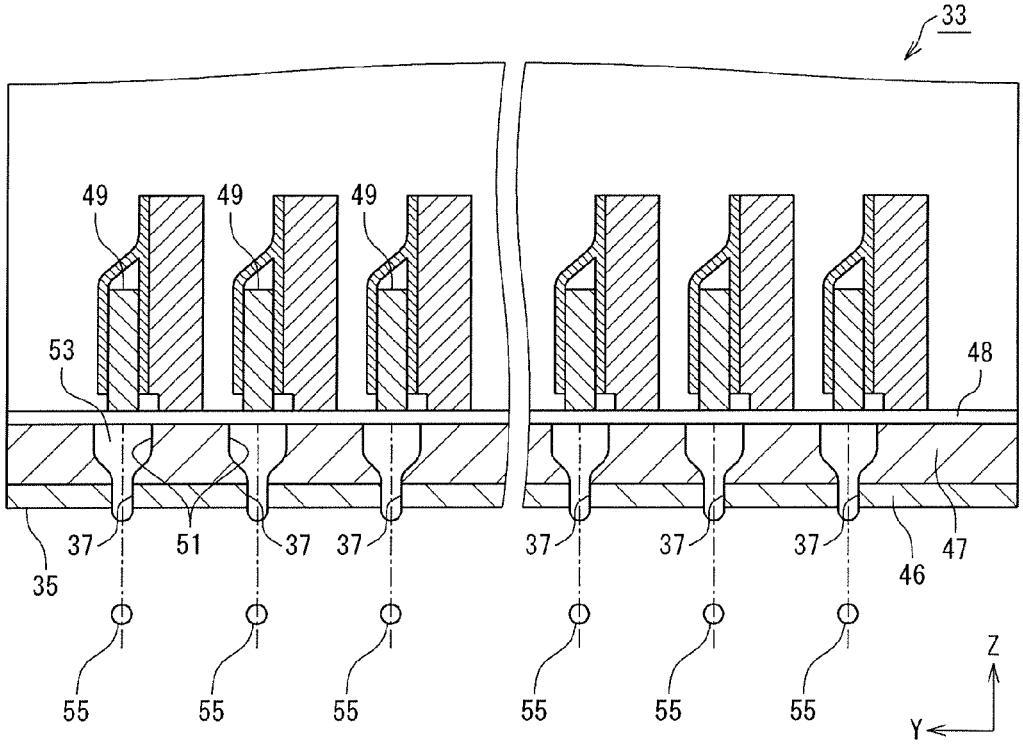
FIG. 4 is a cross-sectional view along line B-B in FIG. 2.

The discharge head 33 has a nozzle plate 46, a cavity plate 47, a vibrating plate 48, and a plurality of piezoelectric elements 49 as shown in FIG. 4, which is a cross-sectional view along line B-B of FIG. 2.

The nozzle plate 46 includes the nozzle surface 35. The nozzles 37 are provided to the nozzle plate 46.

The cavity plate 47 is provided on the side of the nozzle plate 46 opposite the nozzle surface 35. A plurality of cavities 51 are formed in the cavity plate 47. The cavities 51 are provided in correspondence to the nozzles 37 and are communicated with their corresponding nozzles 37. The functional liquid 53 is supplied to the cavities 51 from a tank (not shown).

The vibrating plate 48 is provided to the cavity plate 47 on the side opposite the nozzle plate 46. The vibrating plate 48 vibrates in the Z direction (longitudinal vibration), thereby enlarging and reducing the internal volumes of the cavities 51.

The piezoelectric elements 49 are provided to the vibrating plate 48 on the side opposite the cavity plate 47. The piezoelectric elements 49 are provided in correspondence to the cavities 51, and are made to face the cavities 51 with the vibrating plate 48 in between. The piezoelectric elements 49 stretch based on a drive signal. The vibrating plate 48 thereby reduces the internal volumes of the cavities 51. At this time, pressure is applied to the functional liquid 53 inside the cavities 51. As a result, the functional liquid 53 is discharged as droplets 55 from the nozzles 37. The method of discharging droplets 55 from the discharge head 33 is an example of the inkjet method. The inkjet method is an example of a coating method.

The discharge head 33 having the configuration described above is supported on the head plate 31 in a state in which the nozzle surface 35 protrudes from the head plate 31, as shown in FIG. 2.

The carriage 7 supports the head unit 13 as shown in FIG. 2. The head unit 13 herein is supported on the carriage 7 in a state in which the nozzle surface 35 faces downward in the Z direction.

The workpiece W can be coated with the functional liquid 53 by the discharge head 33 as described above.

In the present embodiment, longitudinally vibrating piezoelectric elements 49 are used, but the pressurizing means for applying pressure to the functional liquid 53 is not limited to these elements, and flexibly deforming piezoelectric elements made of a stacked bottom electrode, piezoelectric layer, and top electrode can also be used, for example. The pressurizing means can also be a so-called electrostatic actuator, wherein static electricity is generated between a vibrating plate and an electrode and the vibrating plate is deformed by the electrostatic force to discharge liquid droplets from nozzles. Another configuration that can be used is one in which a heating element is used to form bubbles in the nozzles and pressure is applied to the functional liquid by the bubbles.

In the present embodiment, a functional liquid 53 that begins to harden by being irradiated with light is used as the functional liquid 53. In the present embodiment, the ultraviolet light 41 is used as the light that causes the functional liquid 53 to harden.

The functional liquid 53 includes a resin material, a photoinitiator, and a solvent as components. By adding to these components a pigment, dye, or other colorant; and a surface-modifying material or other functional material having a property such as lyophilicity or liquid repellency; a functional liquid 53 having a unique function can be created. A functional liquid 53 containing a pigment, dye, or other colorant can be used as the functional liquid 53 for forming an image to be recorded on the workpiece W, for example. Hereinbelow, the functional liquid 53 for forming an image to be recorded on the workpiece W is referred to as an image coating.

By using an acrylic resin material or another phototransparent resin material, for example, as the resin material component of the functional liquid 53, a phototransparent functional liquid 53 can be created. A possible application for a phototransparent functional liquid 53 is clear ink, for example. The phototransparent functional liquid 53 is hereinbelow referred to as a translucent material.

Possible applications of the clear ink include application as an overcoat layer for covering the image, application as a base layer before the image is formed, and other applications, for example. The functional liquid 53 applied as a base layer is hereinbelow referred to as a base coating.

Not only can the translucent coating be used as the base coating, but a functional liquid 53 having various pigments added to the translucent coating can be used as well. For example, a functional liquid 53 white in color, a functional liquid 53 exhibiting a metallic luster, and the like can be used as the base coating.

The resin material in the functional liquid 53 is a material for forming a resin film. Such a resin material is a liquid at room temperature, and is not particularly limited as long as it is a material that becomes a polymer by being polymerized. The resin material preferably has low viscosity, and the resin material is preferably in the form of an oligomer. It is even more preferable that the resin material be in the form of a monomer.

The photoinitiator is an additive that acts on the cross-linking groups of polymers and promotes a cross-linking reaction. Benzyl dimethyl ketal or the like, for example, can be used as the photoinitiator. In the present embodiment, a radical photoinitiator is used as the photoinitiator. IRGACURE 819 made by Ciba Japan®, for example, can be used as the radical photoinitiator.

The solvent is for adjusting the viscosity of the resin material.

The carriage conveying device 11 has a mounting 101 and a guide rail 103, as shown in FIG. 1.

The mounting 101 extends in the X direction and reaches beyond the workpiece conveying device 3 in the X direction. The mounting 101 faces the workpiece conveying device 3 from the side of the workpiece table 25 opposite the press platen 21. The mounting 101 is supported by a pair of supports 107. The two supports 107 are provided to positions where they face each other in the X direction with the press platen 21 in between.

Hereinbelow, the terms support 107*a* and support 107*b* are used when distinguishing between the two supports 107. The support 107*a* and support 107*b* both protrude above the workpiece table 25 in the Z direction. Space is thereby maintained between the mounting 101 and the workpiece table 25.

The guide rail 103 is provided to the side of the mounting 101 that faces the press platen 21. The guide rail 103, which extends along the X direction, is provided along the entire width of the mounting 101 in the X direction.

The previously described carriage 7 is supported on the guide rail 103. With the carriage 7 being supported on the guide rail 103, the nozzle surface 35 of the discharge head 33 faces toward the workpiece table 25 in the Z direction. The carriage 7 is guided along the X direction by the guide rail 103, and is supported on the guide rail 103 so as to be capable of reciprocating in the X direction. The nozzle surface 35 and the placement surface 25*a* of the workpiece table 25 face each other with a space thereinbetween in a state in which the carriage 7 overlaps the workpiece table 25 in a plan view.

The carriage 7 can be reciprocated in the X direction by a movement mechanism and a motive power source (neither shown). The movement mechanism can be a mechanism that combines a ball screw and a ball nut, a linear guide mechanism, or the like, for example. In the present embodiment, a carriage conveying motor (not shown) is used as a motive power source for moving the carriage 7 along the X direction. Various motors can be used as the carriage conveying motor, including a stepping motor, a servo motor, a linear motor, and the like.

The motive power from the carriage conveying motor is transmitted through the movement mechanism to the carriage 7. The carriage 7 can thereby reciprocate along the guide rail 103, i.e., along the X direction. In other words, the carriage conveying device 11 can cause the head unit 13 supported on the carriage 7 to reciprocate along the X direction.

With the liquid discharge device 1 having the configuration described above, a pattern is recorded (drawn) on the workpiece W by discharging droplets 55 from the discharge head 33 while the discharge head 33 and the workpiece W are relatively reciprocated in a state in which the discharge head 33 faces the workpiece W.

The liquid discharge device 1 has a controller 111 for controlling the actions of the configurations described above, as shown in FIG. 5. The controller 111 has a CPU (Central Processing Unit) 113, a drive controller 115, and a memory 117. The drive controller 115 and the memory 117 are connected to the CPU 113 via a bus 119.

The liquid discharge device 1 also has a carriage conveying motor 121, a workpiece conveying motor 123, an input device 129, and a display device 131.

The carriage conveying motor 121 and the workpiece conveying motor 123 are both connected to the controller 111 via an input/output interface 133 and the bus 119. The input device 129 and the display device 131 are also both connected to the controller 111 via the input/output interface 133 and the bus 119.

The carriage conveying motor 121 generates drive force for driving the carriage 7. The workpiece conveying motor 123 generates drive force for driving the workpiece table 25.

The input device 129 is a device for inputting various working conditions. The display device 131 is a device for displaying working conditions and operating conditions. The operator who operates the liquid discharge device 1 can input various information via the input device 129 while confirming the information displayed on the display device 131.

The discharge head 33, the radiation device 15*a*, and the radiation device 15*b* are both connected to the controller 111 via the input/output interface 133 and the bus 119.

The input device 129 is a device for inputting various working conditions. Various information can be inputted via the input device 129.

The CPU 113 performs various calculation processes as a processor. The drive controller 115 controls the driving of the configurations. The memory 117 includes RAM (Random Access Memory), ROM (Read Only Memory), and the like. The memory 117 is provided with a section for storing program software 135 on which procedures for controlling the actions of the liquid discharge device 1 are written, a data decompressor 137 which is a section for temporarily decompressing various data, and the like. Examples of data decompressed in the data decompressor 137 include recording data showing a pattern to be recorded, program data of recording processes and the like, etc.

The drive controller 115 has a motor controller 141, a discharge controller 145, a radiation controller 147, and a display controller 151.

The motor controller 141 separately controls the driving of the carriage conveying motor 121 and the driving of the workpiece conveying motor 123 on the basis of commands from the CPU 113.

The discharge controller 145 controls the driving of the discharge head 33 on the basis of commands from the CPU 113.

The radiation controller 147 separately controls the light-emitting states of the respective light sources 43 of the radiation device 15*a* and radiation device 15*b* on the basis of commands from the CPU 113.

The display controller 151 controls the driving of the display device 131 on the basis of commands from the CPU 113.

The recording process in the liquid discharge device 1 is described here.

Figure 6:
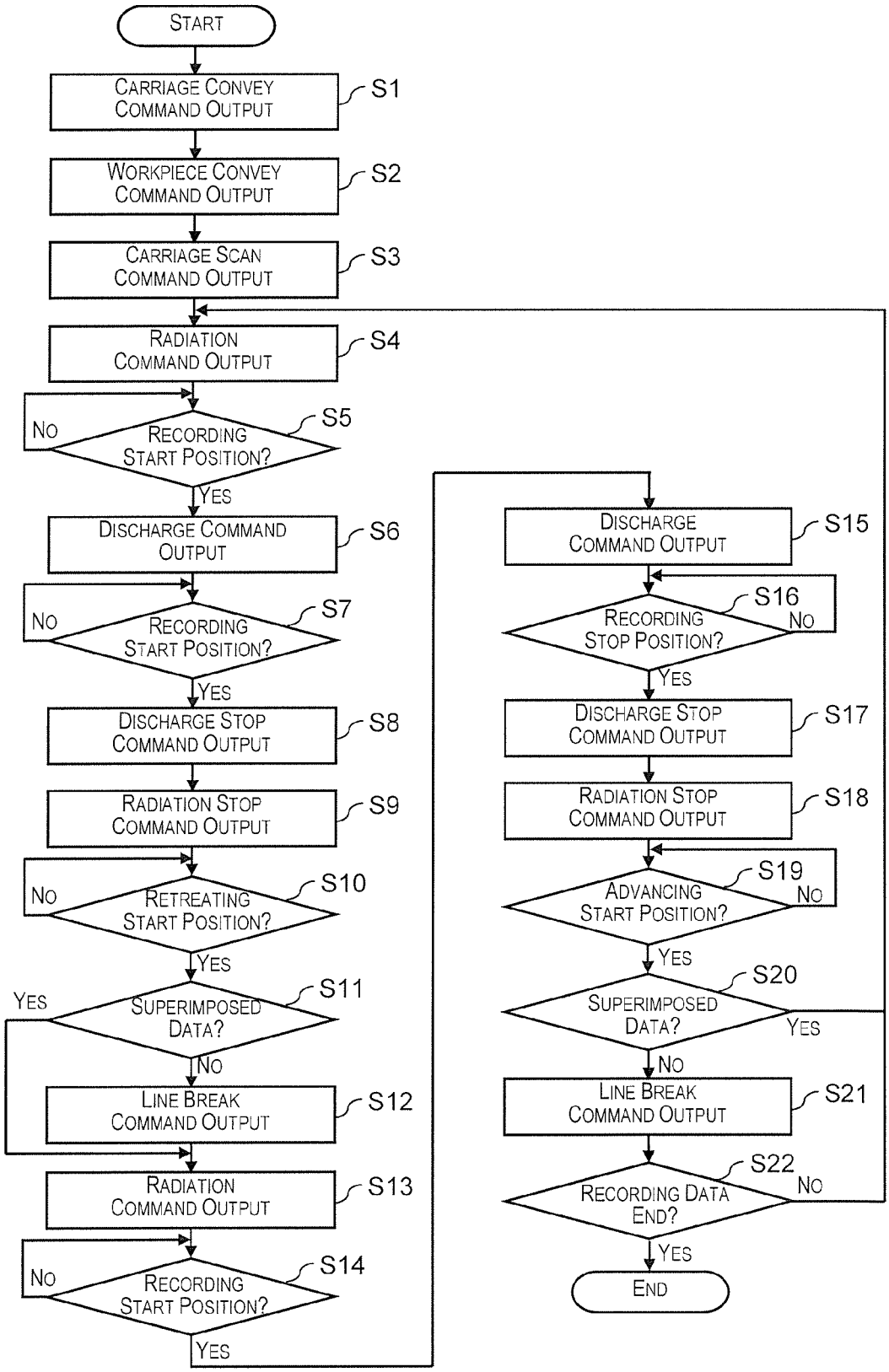
FIG. 6 is a chart showing the flow of the recording process in the present embodiment.

In the liquid discharge device 1, when the controller 111 receives recording data from the input device 129 via the input/output interface 133 and the bus 119, the recording process shown in FIG. 6 is started by the CPU 113.

The recording data indicates a pattern to be recorded on the workpiece W with the functional liquid 53 (liquid substance), and dots to be formed by droplets 55 are expressed in bitmap format. The pattern recorded on the workpiece W is expressed as a collection of a plurality of dots formed by droplets 55. The pattern is recorded on the workpiece W by discharging droplets 55 from the discharge head 33 in predetermined cycles while relatively reciprocating the discharge head 33 and the workpiece W in a state in which the discharge head 33 faces the workpiece W.

Figure 5:
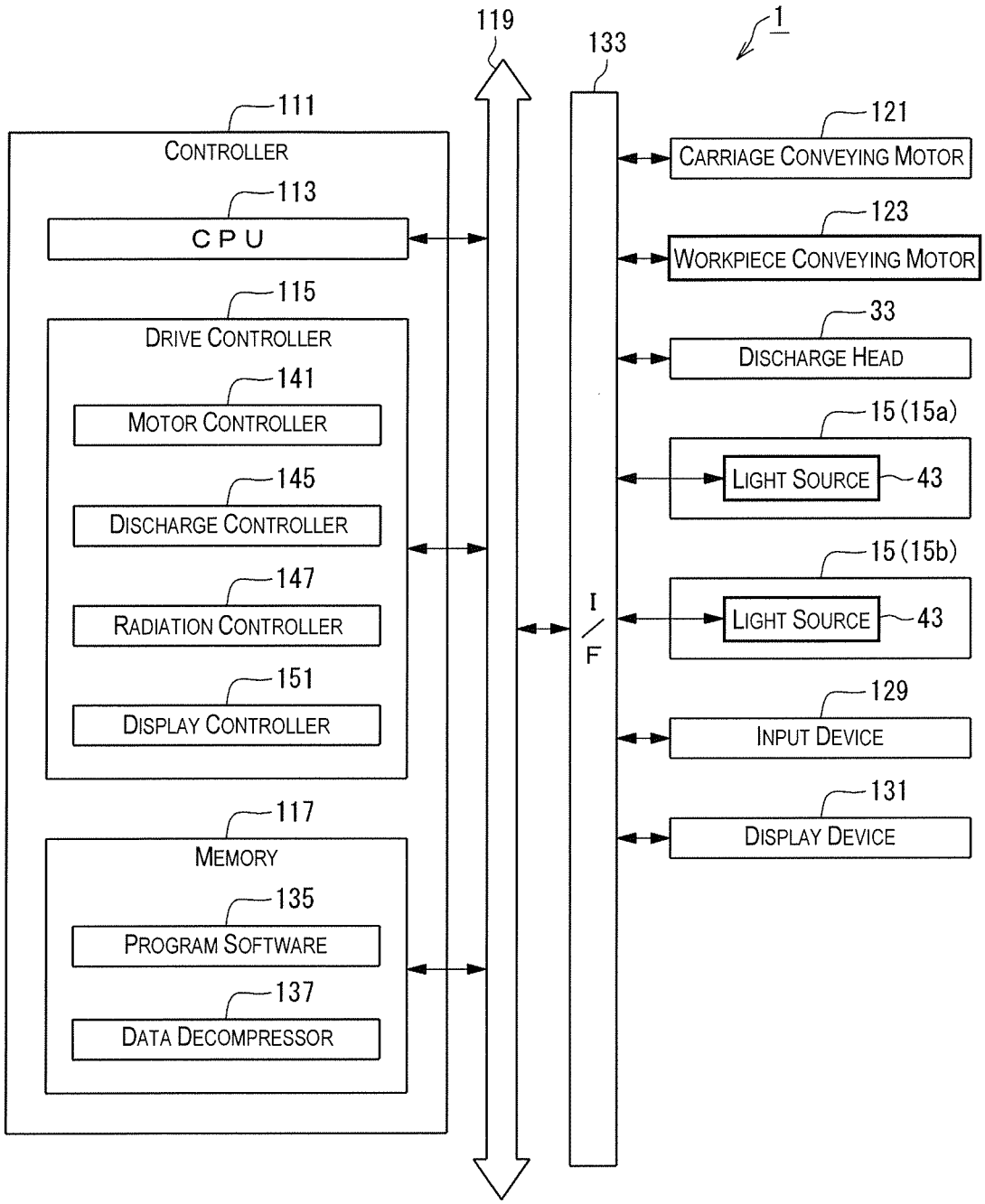
FIG. 5 is a block diagram showing the schematic configuration of the liquid discharge device in the present embodiment.

In the recording process, the CPU 113 first outputs a carriage convey command to the motor controller 141 (FIG. 5). At this time, the motor controller 141 controls the driving of the carriage conveying motor 121, causing the carriage 7 to move to an advancing start position of the drawing area.

A recording area is set in the liquid discharge device 1. The recording area is a section of overlap between the path along the Y direction through which the workpiece table 25 shown in FIG. 1 moves, and the path along the X direction through which the discharge head 33 moves.

The advancing start position is a position where the carriage 7 begins to advance during its reciprocating movement. In the present embodiment, the advancing start position is positioned outside of the recording area in a plan view.

In the present embodiment, the advancing start position is positioned to the side of the recording area in the direction of the support 107*a* in a plan view.

Next, in step S2, the CPU 113 outputs a workpiece convey command to the motor controller 141 (FIG. 5). At this time, the motor controller 141 controls the driving of the workpiece conveying motor 123, causing the workpiece W to move to the recording area.

Next, in step S3, the CPU 113 outputs a carriage scan command to the motor controller 141 (FIG. 5). At this time, the motor controller 141 controls the driving of the carriage conveying motor 121, starting the reciprocating movement of the carriage 7.

During the reciprocating movement of the carriage 7, the carriage 7 reciprocates between the aforementioned advancing start position and a retreating start position. In other words, the route of moving from the advancing start position to the retreating start position and then back to the advancing start position is one reciprocation of the carriage 7. Therefore, in the present embodiment, the route from the advancing start position to the retreating start position is the advancing of the carriage 7. The route from the retreating start position to the advancing start position is the retreating of the carriage 7.

The retreating start position is a position that faces the advancing start position with the recording area in between in the X direction. The retreating start position is positioned outside of the recording area in a plan view. Therefore, the advancing start position and the retreating start position face each other across the recording area in the X direction in a plan view.

In the present embodiment, the retreating start position is positioned to the side of the recording area in the direction of the support 107*b* in a plan view.

Next, in step S4, the CPU 113 outputs a radiation command for the radiation device 15*a* to the radiation controller 147 (FIG. 5). At this time, the radiation controller 147 controls the driving of the light source 43 of the radiation device 15*a*, causing the light source 43 of the radiation device 15*a* to turn on.

Next, in step S5, the CPU 113 determines whether or not the position of the discharge head 33 has reached a recording start position while advancing.

The recording start position is a position where the discharge of droplets 55 from the discharge head 33 is started within the recording area.

At this time, when it is determined that the position of the discharge head 33 has reached the recording start position (Yes), the process transitions to step S6. When it is determined that the position of the discharge head 33 has not reached the recording start position (No), the process waits until the position of the discharge head 33 reaches the recording start position.

Next, in step S6, the CPU 113 outputs a discharge command to the discharge controller 145 (FIG. 5). At this time, the discharge controller 145 controls the driving of the discharge head 33, causing droplets 55 to be discharged from the nozzles 37 on the basis of the recording data. Recording during advancing is thereby started.

Next, in step S7, the CPU 113 determines whether or not the position of the discharge head 33 has reached a recording stop position during advancing.

The recording stop position is a position where the discharge of droplets 55 from the discharge head 33 is stopped within the recording area.

At this time, when it is determined that the position of the discharge head 33 has reached a recording stop position (Yes), the process transitions to step S8. When it is determined that the position of the discharge head 33 has not reached the recording stop position (No), the process waits until the position of the discharge head 33 reaches the recording stop position.

Next, in step S8, the CPU 113 outputs a discharge stop command to the discharge controller 145 (FIG. 5). At this time, the discharge controller 145 stops the driving of the discharge head 33, causing the discharge of droplets 55 from the nozzles 37 to stop. Recording during advancing thereby ends.

Next, in step S9, the CPU 113 outputs a radiation stop command for the radiation device 15*a* to the radiation controller 147 (FIG. 5). At this time, the radiation controller 147 controls the driving of the light source 43 of the radiation device 15*a*, causing the light source 43 of the radiation device 15*a* to turn off Next, in step S10, the CPU 113 determines whether or not the position of the carriage 7 has reached the retreating start position. At this time, when it is determined that the position of the carriage 7 has reached the retreating start position (Yes), the process transitions to step S11. When it is determined that the position of the carriage 7 has not reached the retreating start position (No), the process waits until the position of the carriage 7 reaches the retreating start position.

Next, in step S11, the CPU 113 determines whether or not there is any superimposed data. Superimposed data is data showing a new recording pattern that will be superimposed over the recording pattern in the recording during advancing that had just ended. At this time, when it is determined that there is superimposed data (Yes), the process transitions to step S13. When it is determined that there is no superimposed data (No), the process transitions to step S12.

In step S12, the CPU 113 outputs a line break command to the motor controller 141 (FIG. 5). At this time, the motor controller 141, having received the line break command, controls the driving of the workpiece conveying motor 123, moving the workpiece W in the Y direction (line break) and moving a new section in the workpiece W on which a pattern is to be recorded to the recording area.

In step S13, the CPU 113 outputs a radiation command for the radiation device 15*b* to the radiation controller 147 (FIG. 5). At this time, the radiation controller 147 controls the driving of the light source 43 of the radiation device 15*b*, causing the light source 43 of the radiation device 15*b* to turn on.

Next, in step S14, the CPU 113 determines whether or not the position of the discharge head 33 has reached the recording start position during retreating. At this time, when it is determined that the position of the discharge head 33 has reached the recording start position (Yes), the process transitions to step S15. When it is determined that the position of the discharge head 33 has not reached the recording start position (No), the process waits until the position of the discharge head 33 reaches the recording start position.

Next, in step S15, the CPU 113 outputs a discharge command to the discharge controller 145 (FIG. 5). At this time, the discharge controller 145 controls the driving of the discharge head 33, causing droplets 55 to be discharged from the nozzles 37 on the basis of the recording data. Recording during retreating is thereby started.

When a transition is made from step S11 to step S13 omitting step S12, recording during retreating is performed on the workpiece W without a line break. A recording pattern from retreating can thereby be superimposed over the recording pattern from advancing. Hereinbelow, recording involving the superimposing of a plurality of recording patterns is referred to as superimposed recording.

Following step S15, in step S16, the CPU 113 determines whether or not the position of the discharge head 33 has reached the recording stop position during retreating. At this time, when it is determined that the position of the discharge head 33 has reached the recording stop position (Yes), the process transitions to step S17. When it is determined that the position of the discharge head 33 has not reached the recording stop position (No), the process waits until the position of the discharge head 33 reaches the recording stop position.

Next, in step S17, the CPU 113 outputs a discharge stop command to the discharge controller 145 (FIG. 5). At this time, the discharge controller 145 stops the driving of the discharge head 33, causing the discharge of droplets 55 from the nozzles 37 to stop. Recording during retreating thereby ends.

Next, in step S18, the CPU 113 outputs a radiation stop command for the radiation device 15*b* to the radiation controller 147 (FIG. 5). At this time, the radiation controller 147 controls the driving of the light source 43 of the radiation device 15*b*, causing the light source 43 of the radiation device 15*b* to turn off.

Next, in step S19, the CPU 113 determines whether or not the position of the carriage 7 has reached the advancing start position. At this time, when it is determined that the position of the carriage 7 has reached the advancing start position (Yes), the process transitions to step S20. When it is determined that the position of the carriage 7 has not reached the advancing start position (No), the process waits until the position of the carriage 7 reaches the advancing start position.

Next, in step S20, the CPU 113 determines whether or not there is any superimposed data. Superimposed data is data showing a new recording pattern that will be superimposed over the recording pattern in the recording during advancing that had just ended. At this time, when it is determined that there is superimposed data (Yes), the process transitions to step S4. When it is determined that there is no superimposed data (No), the process transitions to step S21.

In step S21, the CPU 113 outputs a line break command to the motor controller 141 (FIG. 5). At this time, the motor controller 141, having received the line break command, controls the driving of the workpiece conveying motor 123, moving the workpiece W in the Y direction (line break) and moving a new section in the workpiece W on which a pattern is to be recorded to the recording area.

Next, in step S22, the CPU 113 determines whether or not recording data has ended. At this time, when it is determined that recording data has ended (Yes), the process ends. When it is determined that recording data has not ended (No), the process transitions to step S4.

When a transition is made from step S20 to step S4, recording during advancing is performed on the workpiece W without a line break. In other words, when a transition is made from step S20 to step S4, superimposed recording will be performed.

In step S11 or step S20 in this example, the next recording is performed without a line break when there is superimposed data, but a line break may be used. In this case, a different nozzle group may be used to perform recording on predetermined sections before and after the line break.

When a predetermined section of the recording section is reached, the predetermined section being within a range overlapping the discharge head 33 in a plan view, the predetermined section and the discharge head 33 cross each other multiple times during superimposed recording.

Every time the discharge head 33 crosses the predetermined section, droplets 55 are discharged and a recording pattern is recorded on the recording medium.

Superimposed recording can thereby be performed on the predetermined section.

Such superimposed recording can be applied at times such as when one recording pattern is completed by superimposing a plurality of patterns, for example. If the number of times the predetermined section and the discharge head 33 cross is n (n being an integer of 2 or greater) times, one pattern in the predetermined section is completed by recording on the predetermined section during each of the n crossings. Such superimposed recording can also be expressed as a method for recording one pattern in n passes. For example, a method for completing one pattern in two crossings is a method for recording one pattern in two passes.

In the present embodiment, the phrase "completing one pattern in n crossings" means that in n crossings, the recording rate of the pattern is 100%.

The recording rate is the percentage of the number of dots per unit surface area when the number of dots expressing a completed pattern is 100 per unit surface area.

In the present embodiment, in superimposed recording in which one pattern is completed in n crossings, the 100% recording rate is distributed among the n crossings. The recording rate distributed among the n crossings is 100% when totaled. For example, when one pattern is completed in two crossings, if the recording rate in the first crossing is 50% and the recording rate in the second crossing is 50%, a pattern having a recording rate of 100% can be completed.

In the present embodiment, if the variation in the discharge amount due to individual differences among the plurality of nozzles is dispelled, the amount of droplets discharged per dot in each of the crossings will be equal if the recording data is the same. The amount of radiation of the radiation devices in each of the crossings will also be the same.

The following is a description of a working example in which superimposed recording, wherein one pattern is completed in two crossings, is performed using the liquid discharge device 1 described above.

Working Example 1

In Working Example 1, the recording rate in the first crossing is 80% and the recording rate in the second crossing is 20%.

Comparative Example 1

The following is a description of Comparative Example 1 in which superimposed recording, wherein one pattern is completed in two crossings, is performed using the liquid discharge device 1.

In Comparative Example 1, the recording rate in the first crossing is 20% and the recording rate in the second crossing is 80%.

Comparative Example 2

The following is a description of Comparative Example 2 in which superimposed recording, wherein one pattern is completed in two crossings, is performed using the liquid discharge device 1.

In Comparative Example 2, the recording rate in the first crossing is 100%.

In the working example, Comparative Example 1, and Comparative Example 2, the same pattern is mutually used as the pattern to be completed.

The image qualities of the recorded images were evaluated in the working example, Comparative Example 1, and Comparative Example 2. The evaluation results are shown in Table 1 below.

TABLE 1

| | Image Quality |
|---|---|
| Working Example 1 | ○ |
| Comparative Example 1 | Δ |
| Comparative Example 2 | x |

In the image quality evaluation results of Table 1, the symbol "○" indicates that stripes occurring due to bumps were not observed, i.e., that a high image quality was obtained throughout the entire image.

The symbol "Δ" indicates that strips were more easily observed that the symbol "○."

The symbol "×" indicates that strips were more easily observed that the symbol "Δ."

It is understood from the results shown in Table 1 that the image quality in the working example was more satisfactory than in Comparative Example 1 or Comparative Example 2.

The dot density tends to be sparser as the recording rate decreases. In other words, the lower the recording rate, the less likely the dots are to overlap during the recording thereof, and bumps are therefore less likely to form in the image of the recording thereof. It is believed that by forming an image not prone to bumps in the $n^{th}$ crossing step, the occurrence of bumps in the final image is reduced, and the occurrences of striped patterns are easily suppressed.

Because of the above, it is easy to reduce the occurrences of striped patterns in the image in the superimposed recording of the present embodiment. In other words, during superimposed recording in which one pattern is completed in n crossings, the image quality can easily be improved by reducing the recording rate during the $n^{th}$ crossing step below 100%/n. In the n crossings, with the recording rate during the first crossing denoted by a %, the recording rate during the final crossing denoted by b %, and the recording rate during a predetermined crossing other than the first and final crossings denoted by c %: $a \geq c \geq b$ (and $a > b$).

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording method for recording a liquid substance on a recording medium by discharging droplets from a discharge head onto the recording medium while displacing the discharge head and the recording medium relative to each other, the discharge head discharging the liquid substance as the droplets, the liquid substance having a photocuring property that is hardened by exposure to light radiation, the recording method comprising:

a droplet discharge step of discharging the droplets from the discharge head toward a predetermined section of the recording medium; and a radiation step of radiating the light toward the droplets discharged on the recording medium, the droplet discharge step and the radiation step being performed n times, with n being an integer of 2 or greater, on the predetermined section to complete recording on the predetermined section while the discharge head and the recording medium are displaced relative to each other, a recording rate in the nth discharge step being lowered below 100%/n.

2. The recording method according to claim 1, wherein in the n droplet discharge steps, with a recording rate of a first droplet discharge step being denoted by a %, the recording rate of a final droplet discharge step being denoted by b %, and a recording rate of one of the n droplet discharge steps other than the first or final droplet discharge step being denoted by c %: $a \geq c \geq b$ (and $a > b$).

3. The recording medium according to claim 1, wherein in all of the n droplet discharge steps, an amount of droplets discharged per dot is equal for the same recording data.

4. The recording medium according to claim 1, wherein an amount of light radiated is equal in all the n radiation steps.

5. The recording medium according to claim 1, wherein the light is ultraviolet light.

* * * * *